US006064360A

United States Patent [19]

Sakaedani et al.

[11] Patent Number: 6,064,360

[45] Date of Patent: May 16, 2000

[54] LIQUID CRYSTAL DISPLAY

[75] Inventors: Tetsuya Sakaedani; Takahisa Amemiya; Midori Suzuki, all of Kanagawa-ken, Japan

[73] Assignee: International Business Machines Corporation, Armonk, N.Y.

[21] Appl. No.: 09/074,942

[22] Filed: May 8, 1998

[30] Foreign Application Priority Data

May 27, 1997 [JP] Japan ..... 9-136801

[51] Int. Cl.[7] ..... G09G 3/36

[52] U.S. Cl. ..... 345/92; 345/211; 345/214

[58] Field of Search ..... 345/92, 87, 90, 345/91, 211, 214; 365/226, 227, 228

[56] References Cited

U.S. PATENT DOCUMENTS 5,248,963 9/1993 Yasui et al. ..... 345/211
5,793,346 8/1998 Moon ..... 345/92

*Primary Examiner*—Lun-Yi Lao
*Attorney, Agent, or Firm*—Scully, Scott, Murphy & Presser; Jay P. Sorollini

[57] ABSTRACT

An afterimage occurring on a liquid crystal display is eliminated at the time of turning off the system power with an inexpensive circuit construction, without the need for reserving a special power supply. The afterimage continues to be displayed for a certain period of time after the turning-off of the power supply, and is eliminated by the load capacitance processed by liquid crystal display elements in a liquid crystal display panel.

8 Claims, 3 Drawing Sheets

LIQUID CRYSTAL DISPLAY

BACKGROUND OF THE INVENTION

1. Technical Field

The present invention relates to a liquid crystal display, in which an afterimage continued to be displayed for a certain time after the turning-off of the power is removed by the load capacitance possessed by liquid crystal display elements in a liquid crystal display panel.

2. Prior Art

A TFT type LCD having active switching elements has a structure in which many active switching elements are arranged in a matrix. FIG. 1 shows an equivalent circuit of such TFT. One end of the TFT is connected to a data line, and the other end is connected to a pixel voltage terminal Vp. And, its gate is connected to a gate line N, and the TFT is selectively turned on/off in response to the signal provided to the gate line N. Further, the pixel voltage terminal Vp is connected to a voltage terminal VCOM through a liquid crystal capacitance CLC and connected to a gate line N−1 through a secondary capacitance CS.

Generally, the output from a driver circuit for driving such panel is interrupted simultaneously with the turning-off of the power. Thus, even if the power is turned off to eliminate the display on a screen, sometimes an afterimage like a black spot is seen on the screen for a certain time. The occurrence of such afterimage is caused by the charge held on a load capacitance comprised of the liquid crystal capacitance CLC and the secondary capacitance CS. That is, while the charge is naturally discharged after the power is turned off, it is made visible on the screen by a reflected light as if it is written. Since the degree of the afterimage made visible by the reflected light increases as Aperture ratio of the TFT type LCD increases, it is a problem from the viewpoint of the display screen quality.

To solve the problem of the afterimage display, it is only required that, when the power is turned off, all the gate lines (all the unselected gate lines) supplied with a gate low voltage (for instance, −10 V,) by a gate line driver circuit be supplied with a voltage of the order of +2 V for a certain time period ever after the turning-off of the power. Since the TFTs in the corresponding active switching elements are caused to become a low-resistance state (on-state) by providing a voltage to the unselected gate lines to such extent, the charge in the pixel capacitance can forcibly be discharged to the gate lines on the instant. Accordingly, it is possible to instantaneously clear the afterimage.

As a background art related to this problem, there is Published Unexamined Japanese Patent Application No. 1-170986. This is to automatically detect the power-off of a liquid crystal display, and based on that, the TFT of the liquid crystal display element is held to be on for a predetermined time so that the stored charge of the pixel capacity can be discharged in a short time. As shown in the block diagram of FIG. 2, by a source voltage Vl supplied to a terminal 1 from the main body of a liquid crystal display, a capacitor 2*b* of a large capacitance is charged through a diode 2*a*. The source voltage Vl is also supplied to a gate bus driver circuit 3. This source voltage holding circuit 2 is to hold the power of the operation power supply provided to a liquid crystal display panel for a predetermined time even after the power to the liquid crystal display is turned off. A voltage drop detection circuit 4 is to detect the voltage drop of the source voltage Vl, and simultaneously holds the outputs of the gate bus driver circuit 3 at an active level for a predetermined time in response to the detected signal.

That is, in this method, when the system power Vl is turned off, the power within the LCD panel is not immediately turned off, but, first the voltage drop from the system is detected and a voltage supply circuit for rising the gate voltage is operated. Thereafter, after the afterimage on the screen is removed, to turn off the main power to the LCD panel, instructions are sent to the power circuit to finally turn off the power.

However, the background art has the following problems. First, since the source voltage Vl is supplied to the gate bus driver circuit 3 through the diode 2*a*, a voltage drop occurs in the diode 2*a*. To solve the disadvantage due to the voltage drop, the above publication includes a description that the voltage Vl itself may be made larger or a DC-DC converter may be provided on the input side of the power holding circuit 2 to increase the voltage. However, it cannot be denied that the circuit design is made complicated by the provision of such circuit.

Further, as a larger essential problem, it is required to reserve a power supply for operating circuits such as a circuit for detecting the turn-off of the system power, or an afterimage removal power hold/supply circuit and a power turn-off request/enable circuit after the afterimage removal, which are needed in the above art, after the system power Vl is turned off. However, circuit construction therefor is complex and expensive.

SUMMARY OF THE INVENTION

Accordingly, it is an object of the present invention to effectively remove the afterimage display after the turn-off of the power, which is due to the load capacitance in the TFT type LCD.

It is a further object of the present invention to remove the afterimage display only by a simple circuit construction.

To solve the above problems, the present invention provides a liquid crystal display in which many active switching elements are arranged in a matrix, each of the active switching elements has a transistor, and an afterimage occurring when the supply of the source voltage is stopped is removed, the liquid crystal display comprising: gate lines connected to the gates of the transistors in the active switching elements; a first node supplied with a second source voltage generated from the source voltage; charge storage means for storing a predetermined charge; a P-channel transistor connected between the first node and the charge storage means; a second node connected to the gate of the P-channel transistor; voltage supply means for supplying the second node with a voltage causing the P-channel transistor to be maintained in a high-resistance state while the source voltage is supplied to the liquid crystal display; voltage reducing means for using a capacitive coupling to reduce the voltage of the second node to a voltage causing the P-channel transistor to become a low-resistance state in response to the change in the source voltage if the supply of the source voltage of the liquid crystal display is stopped; and control means for supplying the charge stored in the charge storage means to the gate lines through the first node in response to the P-channel transistor having become a low-resistance state, thereby to cause the transistors in the active switching elements to become a low-resistance state.

Further, the present invention is related to a method for controlling the afterimage removing circuit provided in a liquid crystal display in which many active switching elements are arranged in a matrix, each of the active switching elements has a transistor, and gate lines are connected to the gates of the transistors in the active switching elements. The afterimage removing circuit comprises a first node for supplying a second source voltage generated from the source voltage and lower than the source voltage, a charge storage circuit for storing a predetermined charge, and a P-channel transistor connected between the first node and the charge storage means and having the gate thereof connected to a second node. To remove the afterimage occurring when the supply of the source voltage is stopped, the afterimage removing circuit is controlled as follows.

(a) A step of supplying the second node with a voltage causing the P-channel transistor to be maintained in a high-resistance state while the source voltage is supplied to the liquid crystal display.

(b) A step of using a capacitive coupling to reduce the voltage of the second node to a voltage causing the P-channel transistor to become a low-resistance state in response to the change in the source voltage if the supply of the source voltage of the liquid crystal display is stopped.

(c) A step of supplying the stored predetermined charge to the gate lines through the first node in response to the P-channel transistor having become a low-resistance state, thereby to cause the transistors in the active switching elements to become a low-resistance state.

In such an arrangement, the control for supplying the charge stored in the charge storage means to a gate line is performed by the P-channel transistor as a switching element. First, while the power is on, a voltage is supplied so as to cause the P-channel transistor to be turned off. Since the source voltage rapidly changes from a certain value to zero if the power is turned off, a capacitive coupling can be used to turn on the P-channel transistor. By causing the potential of the gate line to rise by the charge stored in the charge storage means to cause the transistor in the active switching element to become a low-resistance state (generally, on-state), the charge stored in the element can instantaneously be discharged.

BRIEF DESCRIPTION OF THE DRAWINGS

Preferred embodiments of the present invention will now be described, by way of example only, with reference to the accompanying drawings, in which.

DETAILED DESCRIPTION OF THE PREFERRED EMBODIMENTS OF THE INVENTION

Figure 3:
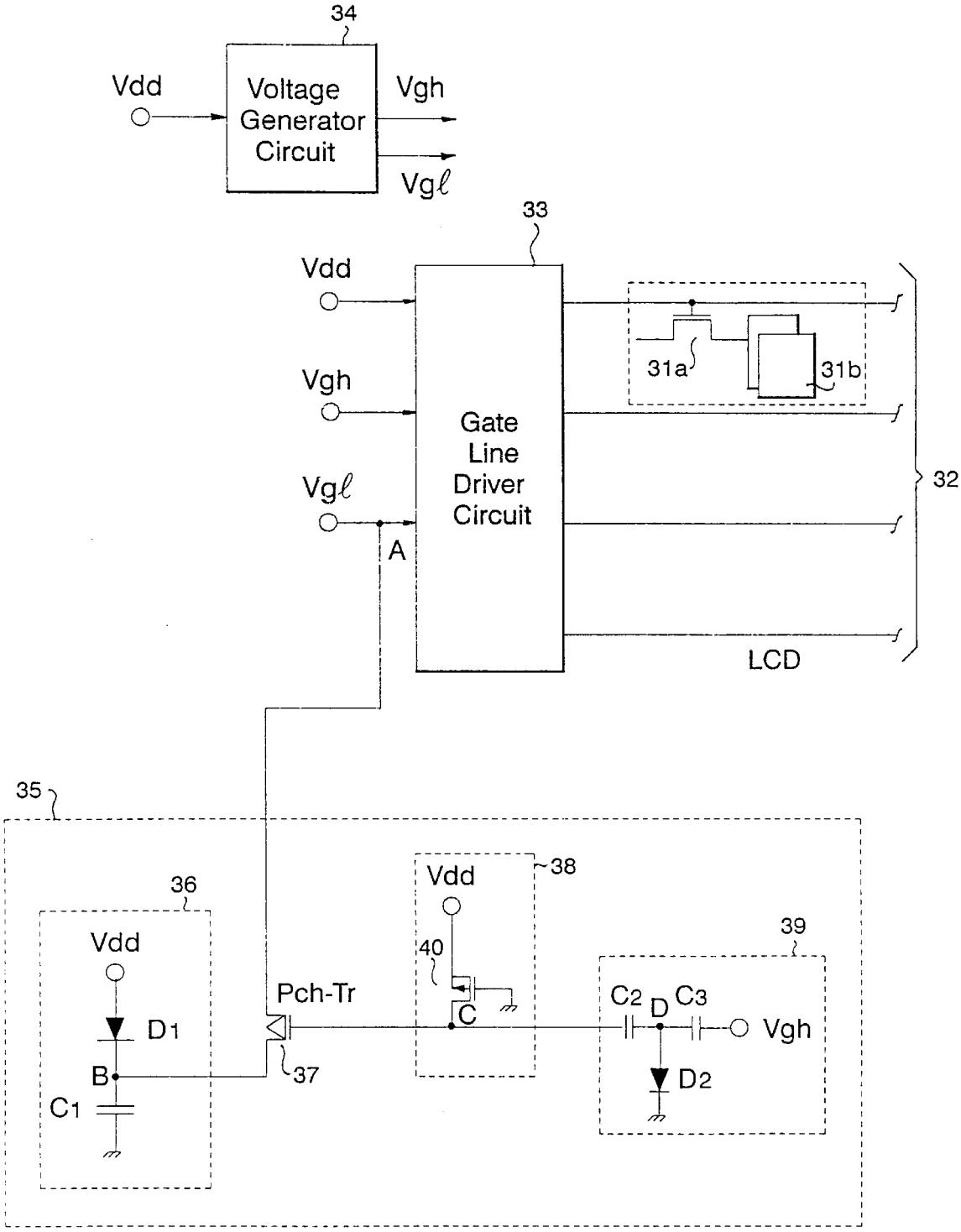
FIG. 3 is a schematic circuit diagram of the liquid crystal display in the present embodiment.

FIG. 3 is a schematic circuit diagram of the liquid crystal display in the present embodiment. In the TFT type LCD, many active switching elements 31 are arranged in a matrix. Each active switching element consists of an FET 31*a* and opposed pixel electrodes 31*b*. The gate of each FET 31*a* is connected to a gate line 32, and its source is connected to a source line, not shown. A gate line driver circuit 33 is to selectively select desired gate lines, and to the selected gate lines, a gate high voltage Vgh, a third source voltage, is supplied. And, to all the other gate lines which are not selected (unselected gate lines), a gate low voltage Vgl, a second source voltage, is supplied. A voltage generation circuit 34 is to generate various voltages such as the gate high voltage Vgh (e.g. +20 V) and the gate low voltage Vgl (e.g. −10 V) if the external power supplied to the liquid crystal display is a single source voltage Vdd (e.g. +5 V).

If the source voltage Vdd is supplied to the liquid crystal display, the gate low voltage Vgl is supplied to a node A, and the gate line driver circuit 33 operates under the source voltages such as the source voltage Vdd, the gate high voltage Vgh, and the gate low voltage Vgl which is the potential of the node A. An afterimage circuit 35 comprises a charge storage circuit 36, a P-channel transistor 37, a voltage supply circuit 38, and a voltage reducing circuit 39.

In the charge storage circuit 36, a diode D1 and a capacitance are serially connected between a source voltage terminal Vdd and a ground potential terminal Vss. And, when the power for the liquid crystal display is on (Vdd is supplied), a predetermined charge is stored in the capacitance C1 through the diode D1. The capacitance C1 is set to a capacity which can cause the potential of a plurality of unselected gate lines to rise to a predetermined potential (e.g. about +2 V).

The drain of the P-channel transistor 37 is connected to the node A, the source is connected to a node B in the charge storage circuit 36, and the gate is connected to a node C in the voltage supply circuit 38. The transistor 37, described below in detail, is a switching element which is off (high-resistance state) when the power is on, and changes to on (low-resistance state) when the power is turned off. Accordingly, it supplies a charge to unselected gate lines through the gate line driver circuit 33 only when the power is turned off.

The voltage supply circuit 38 is a P-channel transistor 40 provided between the source voltage terminal Vdd and the node C, and its gate is fixedly supplied with the ground potential. With this, when the power is on, the voltage of the node C is maintained at a voltage causing the P-channel transistor 37 to be turned off.

The voltage reducing circuit 39 consists of two capacitances C2 and C3, and a diode D2. The capacitance C2 is provided between the node C and a node D, and the capacitance C3 is provided between the node D and a gate high potential terminal Vgh. And, the diode D2 is forward-connected in the ground direction from the node D. As long as the gate high potential voltage Vgh is stable when the power is on, the potential of the node D is zero, and it has no effect on the potential of the node C which is stabilized by the voltage supply circuit 38.

Now, description is made to the operation for the case in which the supply of the power to the liquid crystal display is stopped. In this case, the source voltage Vdd instantaneously changes to zero. Thus, not only the source voltage Vdd, but also the high gate voltage Vgh and the low gate voltage Vgl generated therefrom in stantaneously change to zero. Accordingly, this causes the potential of the source voltage terminal Vdd in the charge storage circuit 36 to become zero, but, since the diode D1 is connected, the charge in the capacitance C1 is not discharged to the source voltage terminal Vdd side (which has changed to zero).

The source voltage terminal Vdd in the voltage supply means 38 also becomes zero, but, since the potential of the node C in a floating state is higher, the potential of the node C is not decreased by the P-channel transistor 40. However, since the potential of the gate high voltage terminal Vgh in the voltage reducing circuit 39 instantaneously becomes zero (for instance, changes from +20 V to 0 V), the potential of the node C is made to drop at a time by the capacitive coupling between the capacitances C2 and C3, thereby to turn on the P-channel transistor 37. As a result, the potential of the node A is risen by the charge stored in the capacitance C1, and that voltage is supplied to the gate line driver circuit 33.

Consequently, the potential of a plurality of gate lines 31 unselected by the gate line driver circuit 33 rises (e.g. about +2 V), turning on the FET 31*a* in the active switching element 31 (low-resistance state). This causes the charge stored in the element 31 to be forcibly discharged, for instance, to a source line. Since the charge stored in the active switching element 31 can forcibly be discharged, it is possible to erase the displayed afterimage faster than the case in which it is naturally discharged.

Thus, in the present embodiment, using the instantaneous change in the source voltage which occurs when the power is turned off, and the capacitive coupling in the voltage reducing circuit, the switching of the P-channel transistor is performed to execute the elimination of the afterimage. Accordingly, there are advantages that it is not necessary to reserve a special power supply for the operation after the turn-off of the system power, which was required in the background art, and that only a very simple and inexpensive circuit construction is needed.

The above description has been made to the case in which the afterimage removing circuit 35 is provided on the terminal side of the gate low voltage supplied to the gate line driver circuit 33. However, the present invention is not limited to this, and it is to be understood that it may be provided directly on the gate line 32 side without through the gate line driver circuit 33.

Figure 1:
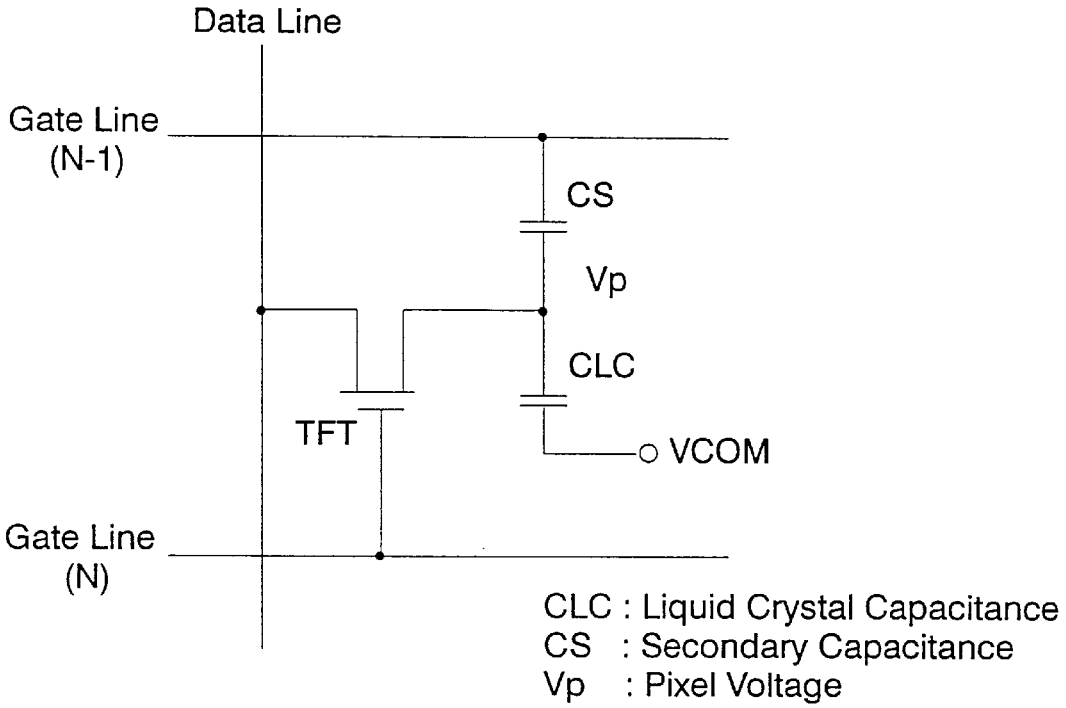
FIG. 1 is an equivalent circuit of the TFT.
Figure 4:
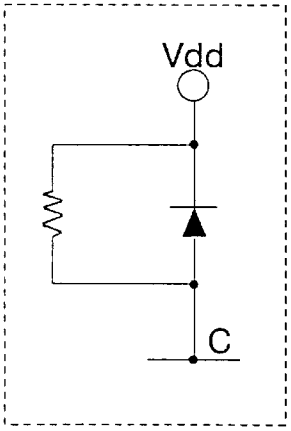
FIG. 4 is a circuit diagram showing another embodiment of the voltage supply circuit.
Figure 2:
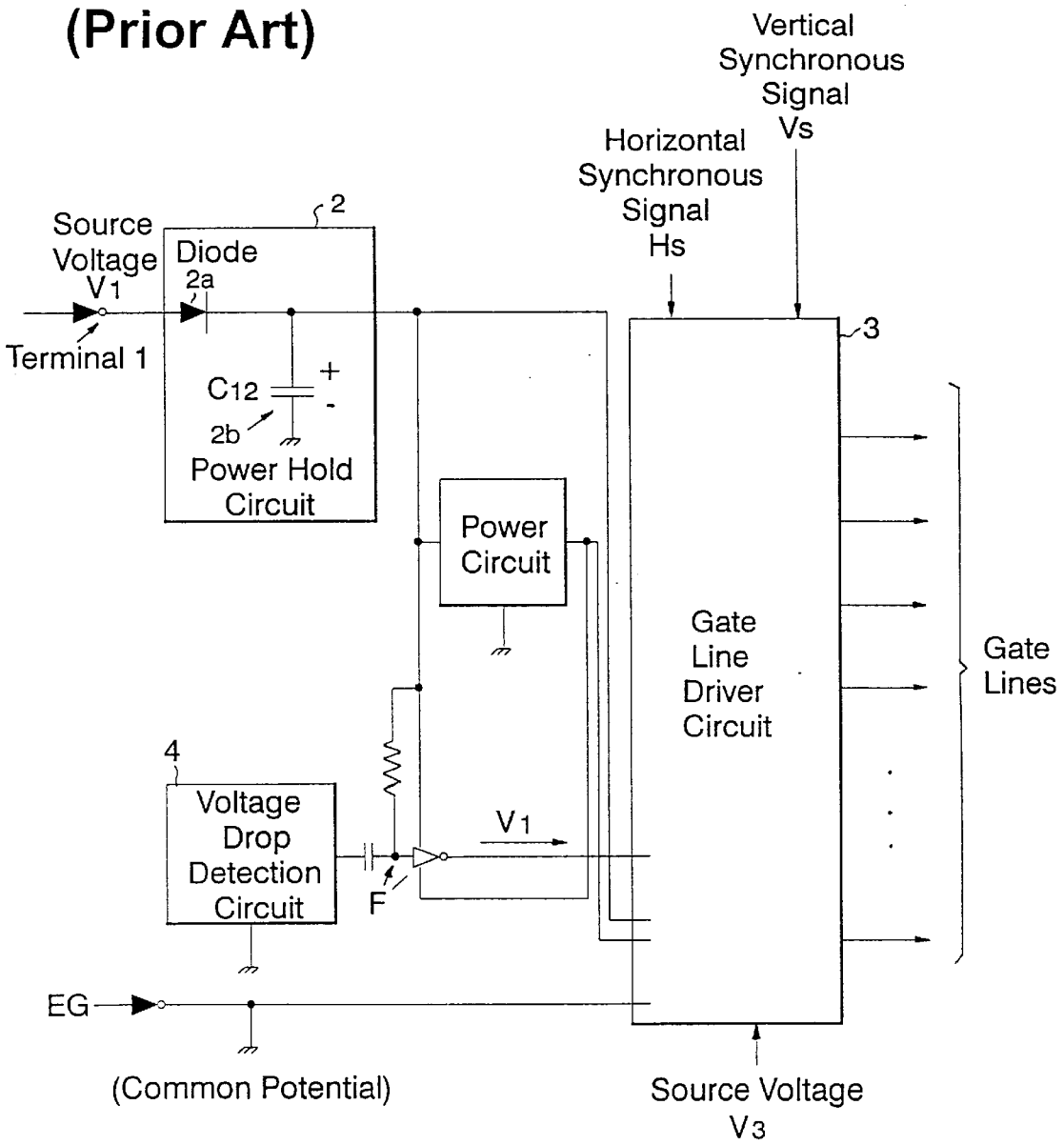
FIG. 2 (Prior Art)
FIG. 2 is a block diagram for explaining the background art.

Further, the voltage supply circuit 38 may be constructed as shown in FIG. 4. By providing a resistor in parallel with a diode in this way, the timing of turning on the P-channel transistor 37 can controlled more easily.

Thus, in accordance with the present invention, the afterimage occurring when the power is turned off can be eliminated with a very simple and inexpensive circuit construction, without reserving a special power supply for operating the circuit after the turn-off of the system power.

While the invention has been particularly shown and described with respect to preferred embodiments thereof, it will be understood by those skilled in the art that the foregoing and other changes in form and details may be made therein without departing from the spirit and scope of the invention.

What is claimed is:

1. A liquid crystal display having many active switching elements arranged in a matrix, each of said active switching elements having a transistor, so as to remove an afterimage occurring when the supply of a first source voltage is stopped, said liquid crystal display comprising:

gate lines connected to gates of said transistors in said active switching elements;

a first node supplied with a second source voltage generated from said source voltage;

charge storage means of restoring a predetermined charge;

a P-channel transistor connected between said first node and said charge storage means;

a second node connected to the gate of said P-channel transistor;

voltage supply means for supplying said second node with a voltage causing said P-channel transistor to be maintained in a high-resistance state while said first source voltage is supplied to said liquid crystal display;

voltage reducing means for using capacitive coupling to reduce the voltage of said second node to a voltage causing said P-channel transistor to become a low-resistance state in response to the change in said source voltage if the supply of the first source voltage of said liquid crystal display is stopped; and control means for supplying the charge stored in said charge storage means to said gate lines through said first node in response to said P-channel transistor having become a low-resistance state, thereby to cause said transistors in said active switching elements to become a low-resistance state.

2. A liquid crystal display according to claim 1, wherein said control means are a gate line driver circuit for selectively selecting desired said gate lines, and said gate line driver circuit supplies the charge stored in said charge storage means to a plurality of unselected said gate lines other than said selected gate line through said first node.

3. A liquid crystal display according to claim 1, wherein said second source voltage is a gate low voltage generated from the source voltage of said liquid crystal display.

4. A liquid crystal display according to claim 3, wherein said control means are a gate line driver circuit, and said transistors in a plurality of said active switching elements which are supplied with said gate low voltage by said gate line driver circuit is caused to become a low-resistance state by the charge stored in said charge storage means.

5. A liquid crystal display according to claim 3, wherein said voltage reducing means have a first capacitance having one end thereof connected to said second node and having the other end thereof connected to a third node, and a second capacitance having one end thereof supplied with a third source voltage and having the other end thereof connected to said third node.

6. A liquid crystal display according to claim 5, wherein said third source voltage is a gate high voltage generated from the first source voltage of said liquid crystal display and higher than said gate low voltage.

7. A liquid crystal display according to claim 5, wherein said voltage reducing means have a diode which is forward-connected from said third node toward the ground potential terminal.

8. In a liquid crystal display in which many active switching elements are arranged in a matrix, each of said active switching elements having a transistor, and gate lines connected to the gates of said transistors in said active switching elements, said liquid crystal display comprising an afterimage removing circuit, said afterimage removing circuit, and a P-channel transistor, said first node being supplied with a second source voltage generated from a first source voltage and lower than said first source voltage, said charge storage storing a predetermined charge; and, said P-channel transistor being connected between said first node and said charge storage circuit, and having the gate thereof connected to a second node, a method for controlling the afterimage removing circuit for removing the afterimage which occurs when the supply of the first source voltage is stopped, said method comprising the steps of:

supplying said second node with a voltage causing said P-channel transistor to be maintained in a high-resistance state while said first source voltage is supplied to said liquid crystal display;

reducing, if the supply of the first source voltage of said liquid crystal display is stopped, the voltage of said second node to a voltage causing said P-channel transistor to become a low-resistance state in response to the change in said second source voltage by using a capacitive coupling; and supplying said stored predetermined charge to said gate lines through said first node in response to said P-channel transistor having become a low-resistance state, thereby to cause said transistors in said active switching elements to become a low-resistance state.

* * * * *

UNITED STATES PATENT AND TRADEMARK OFFICE

CERTIFICATE OF CORRECTION

PATENT NO. : 6,064,360
APPLICATION NO. : 09/074942
DATED : May 16, 2000
INVENTOR(S) : Tetsuya Sakaedani et al.

It is certified that error appears in the above-identified patent and that said Letters Patent is hereby corrected as shown below:

On The Title Page, [56] References Cited: Insert

-- FOREIGN PATENT DOCUMENTS 0 364590A1 4/1990.....EPO 0 764932A2 3/1997.....EPO --

Column 5, Line 58: “said Source” should read --said first source--

Column 6, Line 6: “said source” should read --said first source--

Signed and Sealed this

Sixth Day of November, 2007

JON W. DUDAS
*Director of the United States Patent and Trademark Office*